US005310617A

United States Patent [19]

Taguchi et al.

[11] Patent Number: 5,310,617

[45] Date of Patent: May 10, 1994

[54] MAGNETIC BRUSH DEVELOPING PROCESS AND DEVELOPER

[75] Inventors: Kyouya Taguchi, Nishinomiya; Takashi Teshima, Ibaragi; Kazuhiko Yamamura, Higashi; Takatomo Fukumoto, Osaka, all of Japan

[73] Assignee: Mita Industrial Co., Ltd., Osaka, Japan

[21] Appl. No.: 593,885

[22] Filed: Oct. 5, 1990

[30] Foreign Application Priority Data

Oct. 5, 1989 [JP] Japan ..... 1-258847
Oct. 5, 1989 [JP] Japan ..... 1-258848
Oct. 9, 1989 [JP] Japan ..... 1-262244

[51] Int. Cl.[5] ..... G03G 13/09; G03G 9/107

[52] U.S. Cl. ..... 430/122; 430/108; 430/111

[58] Field of Search ..... 430/108, 126, 122, 111, 430/45

[56] References Cited

U.S. PATENT DOCUMENTS 4,592,987 6/1986 Mitsuhashi et al. ..... 430/102
4,949,127 8/1990 Matsuda et al. ..... 355/251

*Primary Examiner*—Marion E. McCamish
*Assistant Examiner*—Rosemary Ashton
*Attorney, Agent, or Firm*—Sherman and Shalloway

[57] ABSTRACT

Disclosed are a two-component type developer which is supplied to an area where a bias voltage of at least 250 V is applied, and a developing process using this developer. In this developer, by adjusting the particle size distribution of carrier particles within a specific range, occurrence of the so-called carrier dragging phenomenon of the transfer of the carrier together with the toner to a photosensitive material can be prevented. This adjustment of the particle size distribution is such that the content of carrier particles having a size smaller than 250 mesh is less than 8% by weight based on the entire carrier particles, the diameter $D_{50}$ of the weight average particle size corresponding to 50% of the weight of the entire carrier particles is in the range of from 80 to 120 μm and the difference between $D_{25}$ and $D_{75}$ is in the range of from 5 to 20 μm.

4 Claims, 2 Drawing Sheets

PRESENT INVENTION : ○ TwY-5 (CONTENT OF FINE PARTICLES HAVING SIZE SMALLER THAN 250 MESH IS LOWER THAN 8% BY WEIGHT)

CONVENTIONAL TECHNIQUE : △ $F_2$ (CONTENT OF FINE PARTICLES HAVING SIZE SMALLER THAN 250 MESH IS 27% BY WEIGHT)

PRESENT INVENTION : ○ TwY-5 (CONTENT OF FINE PARTICLES HAVING SIZE SMALLER THAN 250 MESH IS LOWER THAN 8% BY WEIGHT)

CONVENTIONAL TECHNIQUE : △ $F_2$ (CONTENT OF FINE PARTICLES HAVING SIZE SMALLER THAN 250 MESH IS 27% BY WEIGHT)

MAGNETIC BRUSH DEVELOPING PROCESS AND DEVELOPER

BACKGROUND OF THE INVENTION (1) Field of the Invention

The present invention relates to a developer and a developing process. More particularly, the present invention relates to a two-component developer comprising toner particles and carrier particles supporting the toner particles, and a developing process using this developer. Furthermore, the present invention relates to a developer and developing process characterized in that even by a developing mechanism in which the voltage difference between a photosensitive material and a developing sleeve (developer-supporting member) is small, an image having a high density is obtained at a high resolution and so-called carrier dragging is not caused. Still further, the present invention relates to a developer and developing process characterized in that even if a toner having a low electroconductivity is used, an image having a high density is obtained at a high resolution and so-called carrier dragging is not caused.

(2) Description of the Related Art

In the field of commercial electrophotography, magnetic brush development using a two-component magnetic developer is widely adopted for developing an electrostatic image. As the two-component type magnetic developer, there is widely used a mixture comprising a magnetic carrier composed of an iron powder or sintered ferrite particles and a toner composed of particles formed by dispersing additives such as a colorant and a charge-controlling agent in a binder resin.

An ordinary developing mechanism in which a developer as described above is used has a structure as shown in FIG. 1. More specifically, a box-shaped toner supply mechanism 4 is arranged on the developing mechanism 2 and a toner is supplied from above. The toner 6 is fed into a developing device 10 disposed below through a supply opening 8 equipped with a feeder and is stirred together with a carrier in the developing device 10 by stirrers 12 to form a two-component type developer 14.

A developing sleeve (developer-supporting member) 16 equipped with many magnetic poles is arranged in the developing device 10. The developer 14 having the frictionally charged toner is supplied into the developing sleeve and a magnetic brush 18 of the developer is formed on the surface of the sleeve by a magnetic force. The length of the magnetic brush 18 is adjusted by a brush-cutting mechanism (doctor blade) 20, and a uniform layer of the developer is formed on the surface of the developing sleeve 16. This developer layer is delivered to the nip position to a surface photosensitive layer 24 of an electrophotographic photosensitive material drum (image carrier) 22. The photosensitive material drum 22 is arranged apart by a distance DD-S from the developing sleeve 16, and the developing sleeve 16 and photosensitive material 22 are rotatably supported and are driven so that the moving directions of the sleeve 16 and drum 22 are the same at the nip position (the rotation directions are reverse to each other).

A corona charger 26 connected to a variable high voltage power source 25 and an optical system 28 for the light exposure are arranged around the photosensitive material drum 22 upstream of the developing device 10 to form an electrostatic latent image having a predetermined surface voltage. A bias power source 33 equipped with a voltage-adjusting mechanism 30 is connected between the photosensitive drum 22 and the developing sleeve 12 so that an optional value voltage (bias voltage) which has the same polarity as that of the surface voltage and is lower than the surface voltage is applied onto the photosensitive layer 24. A transfer mechanism 34 for transferring a toner image to a copying paper is arranged around the photosensitive layer 24 downstream of the developing zone.

In the above-mentioned structure, the developer 14 forms the magnetic brush 18 on the developing sleeve 16 and at the nip position, this magnetic brush 18 reacts with the electrostatic latent image of the photosensitive layer 24 to form a visible image of the toner on the photosensitive layer 24.

At this image-forming step, it is required that the optical density of the image area should be high and the adhesion of the toner to the background (so-called fogging) should be small. The reason is that this fogging includes a risk of the transfer of the lowly charged toner to the background. As the means for obtaining an image having reduced fogging, there can be considered a method of increasing the bias voltage. If the bias voltage is increased, the quantity of light necessary for the photosensitive layer can be reduced, and therefore, the development speed can be increased.

However, the increase of the bias voltage results in enhancement of the charge repulsion between the magnetic carrier and the developing sleeve, and therefore, the phenomenon of so-called carrier dragging, that is, the phenomenon that the carrier is transferred together with the toner to the photosensitive material, is often caused.

As regards the developing conditions adopted in the conventional Se type photosensitive material drum for the development, the distance DD-S between the photosensitive drum and the developing sleeve and the cutting length of the magnetic brush (the distance between the developing sleeve and the doctor blade) are adjusted to more than about 1 mm, and the development voltage difference is set at such a high level as 550 to 600 V. Under these conditions, troubles such as carrier dragging are not caused even if a conventional developer is used.

Recently, diminishment of the DD-S width is tried for improving the image density. However, if the DD-S width is diminished, the above-mentioned carrier dragging is caused.

An organic photosensitive material which has a good processability and is advantageous in the manufacturing cost and has a large freedom of the design of functions is recently used as the photosensitive material for the electrophotography. The organic photosensitive material includes a negatively chargeable type and a positively chargeable type. Since the negatively chargeable type often induces contamination of the copying environment, use of the positively chargeable organic photosensitive material is now expected.

In this positively chargeable photosensitive material, however, the residual voltage is apt to become larger than in the conventional Se type photosensitive material, and therefore, in the case where the positively chargeable photosensitive material is used, the bias voltage should be maintained at a level higher than 250 V. As shown in FIG. 2, if the bias voltage is high, it is obvious that the carrier loss is frequently caused in case of the conventional developer (broken line Δ). Recently, under the necessity of increasing the bias voltage of the photosensitive material, it is required that the development voltage difference, that is, the difference between the surface voltage and the bias voltage should be up to 500 V. In case of the conventional developer and developing process, however, if the development voltage difference is controlled to 500 V or less, reducti on of the image density is caused and no satisfactory results can be obtained.

When a color image is formed, a dye or pigment of a desired color, other than a black dye such as carbon, is selected, and in this case, the kinds of toners that can be selected are limited and the electric resistance (the reciprocal of the electroconductivity) of the color toner tends to increase. Therefore, it sometimes happens that the image density (ID) cannot be maintained at a high level. According to the conventional technique, in order to solve these problems, the particle size of the magnetic carrier is reduced and the feed quantity of the toner is increased, or the electric resistance of the magnetic carrier is reduced.

However, even if the physical properties of the magnetic carrier are thus changed, a sufficient image density cannot be given to the color image, and especially in case of a red toner having a low electroconductivity, it often happens that no satisfactory image density can be obtained. Furthermore, there can be considered a method in which the DD-S width is reduced below the DD-S width in the conventional technique to increase the density of the color image. In this method, however, a stress is imposed and carrier dragging is caused.

SUMMARY OF THE INVENTION

It is a primary object of the present invention to provide a developer which is used at such a high bias voltage as 250 V or higher and which provides a high-quality image without occurrence of such troubles as carrier dragging and fogging Another object of the present invention is to provide a developer which is used under developing conditions of a development voltage difference smaller than 500 V and a DD-S width smaller than 1 mm and which does not cause carrier dragging.

Still another object of the present invention is to provide a developer comprising a toner having a low electroconductivity, for example, a red toner, which does not cause carrier dragging or fogging.

A further object of the present invention is to provide a developer for organic photosensitive material, which is frequently used these days, especially a developer for positively chargeable organic photosensitive material.

In accordance with one fundamental aspect of the present invention, there is provided a two-component type developer comprising toner particles and carrier particles supporting the toner particles, wherein carrier particles having a size smaller than 250 mesh occupy less than 8% by weight of the whole carrier of the two-component developer.

In accordance with another aspect of the present invention, there is provided a two-component type developer comprising toner particles and carrier particles supporting the toner particles, wherein in the carrier particles, the diameter $D_{50}$ of the weight average particle size corresponding to 50% of the weight of entire carrier particles is in the range of from 80 to 120 μm and the difference of the diameter $D_{25}$ of the weight average particle size corresponding to 25% of the weight of entire carrier particles and the diameter $D_{75}$ of the weight average particle size corresponding to 75% of the weight of entire carrier particles is in the range of from 10 to 20 μm, and the saturation magnetization of the carrier is 50 to 60 emu/g.

In accordance with still another aspect of the present invention, there is provided a two-component type developer comprising a toner having an electroconductivity lower than $3.0\times10^{-10}$ s/cm and a carrier consisting of particles in which the diameter $D_{50}$ of the weight average particle size corresponding to 50% of the weight of entire carrier particles is in the range of from 80 to 100 μm, the difference between the diameter $D_{25}$ of the weight average particle size corresponding to 25% of the weight of entire carrier particles and the diameter $D_{75}$ of the weight average particle size corresponding to 75% of the weight of entire carrier particles is in the range of from 5 to 20 μm and particles having a particle size smaller than 250 mesh occupy less than 8% by weight of the entire particles.

The developer of the present invention can comprise a red toner containing a red colorant, which has a low electroconductivity. Furthermore, a positively chargeable organic photosensitive material can be used for the developer of the present invention.

In accordance with still another aspect of the present invention, there is provided a developing process, which comprises adjusting the content of particles having a size smaller than 250 mesh in a carrier of a two-component type developer to less than 8% by weight, supporting the two-component type developer comprising said adjusted carrier and a toner on a developer-delivering support, delivering the two-component type developer to a photosensitive material having an electrostatic latent image formed thereon by said developer-delivering support and transferring the toner to the electrostatic latent image while applying a bias voltage of at least 250 V between the developer-delivering support and the photosensitive material.

In the above-mentioned developing process of the present invention, a positively chargeable organic photosensitive material can be used as the photosensitive material.

In accordance with still another aspect of the present invention, there is provided a developing process, which comprises adjusting the particle size of particles of a carrier of a two component-type developer so that the diameter $D_{50}$ of the weight average particle size corresponding to 50% of the weight of entire carrier particles is in the range of from 80 to 120 μm and the difference between the diameter $D_{25}$ of the weight average particle size corresponding to 25% of the weight of entire carrier particles and the diameter $D_{75}$ of the weight average particle size corresponding to 75% of the weight of entire carrier particles is in the range of from 10 to 20 μm, further adjusting the saturation magnetization of the carrier to 50 to 60 emu/g, supporting the two-component type developer comprising said adjusted carrier and a toner on a developer-delivering support, delivering the two-component type developer to a photosensitive material having an electrostatic latent image formed thereon by said developer-delivering support and transferring the toner to the electrostatic latent image while adjusting the distance between the photosensitive material and the delivering support to less than 1 mm and setting the development voltage difference at a level lower than 500 V.

In the above-mentioned developing process of the present invention, in said adjusted carrier, the content of carrier particles having a size smaller than 250 mesh can be adjusted to less than 8% by weight based on the entire particles.

Furthermore, in the above-mentioned developing process of the present invention, a positively chargeable organic photosensitive material can be used as the photosensitive material.

In accordance with still another aspect of the present invention, there is provided a developing process adjusting the dielectric constant of a toner of a two-component type developer to a level lower than $3.1\times10^{-10}$ s/cm, adjusting the particle size of particles of a carrier of the two-component type developer so that the diameter $D_{50}$ of the average particle size corresponding to 50% of the weight of entire carrier particles is in the range of from 80 to 100 μm, the difference between the diameter $D_{25}$ of the weight average particle size corresponding to 25% of the weight of entire carrier particles and the diameter $D_{75}$ of the weight average particle size corresponding to 75% of the weight of entire carrier particles is in the range of from 5 to 20 μm and the content of carrier particles having a size smaller than 250 mesh is less than 8% by weight based on the entire carrier particles, supporting the two-component type developer comprising the adjusted toner and the adjusted carrier on a developer-delivering support, delivering the two-component type developer to a photosensitive material having an electrostatic latent image formed thereon by said developer-delivering support and transferring the toner to the electrostatic latent image while adjusting the distance between the photosensitive material and the delivering support to less than 1.2 mm and setting the development voltage difference at a level lower than 500 V.

In the above-mentioned developing process of the present invention, a red toner comprising a red colorant can be used as the toner.

Furthermore, in the above-mentioned developing process of the present invention, a positively chargeable organic photosensitive material can be used as the photosensitive material.

DETAILED DESCRIPTION OF THE PREFERRED EMBODIMENTS

According to the present invention, in principle, in a two-component type developer to be supplied between a photosensitive material to which a specific bias voltage or a specific development voltage difference is applied and a developing sleeve, or in a two-component type developer comprising a toner having a low electroconductivity, carrier particles are adjusted so as to have specific particle size characteristics, whereby occurrence of carrier dragging is prevented.

More specifically, the present invention is based on the finding that if a carrier in which the content of particles having a size smaller than 250 mesh is lower than 8% by weight based on the entire carrier particles is used for a two-component type developer and the development is carried out under a bias voltage of at least 250 V, which is outside the conventional development condition, a high-density image free of fogging can be obtained without occurrence of so-called carrier dragging.

Furthermore, the present invention is based on the finding that if a carrier in which the diameter $D_{50}$ of the weight average particle size corresponding to the weight of entire carrier particles is in the range of from 80 to 120 μm, the difference between $R_{25}$ and $D_{75}$ is in the range of from 10 to 20 μm and the saturation magnetization is adjusted to 50 to 60 emu/g is used for a two-component type developer, under developing conditions of a development voltage difference smaller than 500 V and a DD-S width smaller than 1 mm, which are outside the conventional development conditions, a good reproducibility of a line image and a high density of a solid image can be attained without occurrence of so-called carrier dragging.

Figure 2:
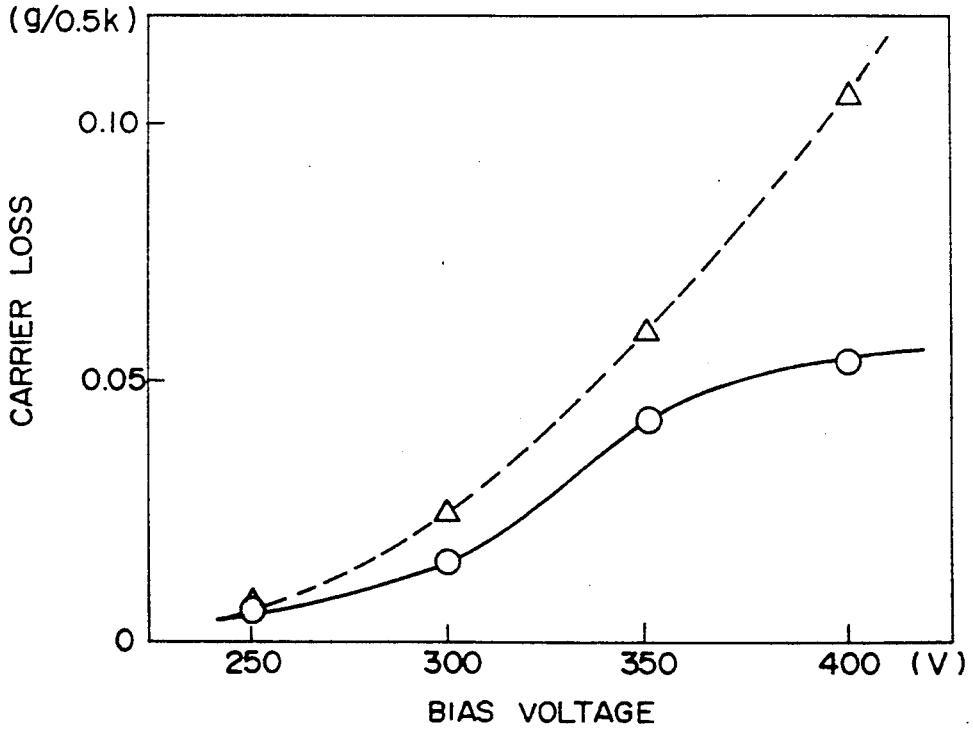
FIG. 2 is a curve illustrating the relation between the bias voltage and carrier dragging.

As shown in FIG. 2, in the conventional developer, carrier dragging become cospicuous with increase of the bias voltage. It is understood that the reason is that since the charge repulsion between the magnetic carrier and the developing sleeve gradually increases, the transfer of the magnetic carrier to the photosensitive material becomes easier. It has been generally considered that dragging of the magnetic carrier depends greatly on the current value and other electrostatic action, but the size of particles of the carrier has hardly been taken into consideration because all the carrier particles are uniformly charged.

In the developer of the present invention, by adjusting the content of particles having a size smaller than 250 mesh in the magnetic carrier to less than 8% by weight, especially less than 5% by weight, based on the entire carrier particles, carrier dragging is prominently controlled even if the bias voltage is increased. The adjustment of the distribution of fine carrier particles having a size smaller than 250 mesh to less than 8% by weight means removal of parts of fine carrier particles from the conventional carrier.

If the development is carried out under such a high bias voltage, as mentioned hereinbefore, fogging can be reduced and a high-quality image can be obtained, and furthermore, the environmental contamination by the lowly charged toner can be controlled to a low level and the quantity of light necessary for the photosensitive material layer can be reduced, with the result that the operation speed in the apparatus can be increased.

Moreover, by increasing the bias voltage, the influence of the residual voltage on the photosensitive material can be reduced. More specifically, even if the residual voltage on the photosensitive material is as high as about 150 V or more, by increasing the bias voltage, the photosensitive material can provide an excellent image quality without fogging. As the photosensitive material having such a high residual voltage, there can be mentioned a positively chargeable organic photosensitive material, and this organic photosensitive material has conditions under which the developer of the present invention is preferably used. By increase of the bias voltage, the development voltage difference, that is, the difference between this voltage and the surface voltage, is reduced, and according to certain circumstances, the development has to be conducted under a low voltage. At this low voltage development, the gradient and image density are degraded. However, if the above-mentioned condition of a DD-S width smaller than 1.2 mm, especially smaller than 1.0 mm, is adopted, both of the gradient and image density can be maintained at high levels and occurrence of carrier dragging is prevened. Also for this reason, the developer of the present invention can be satisfactorily applied to a positively chargeable organic photosensitive material.

In addition to the above-mentioned two-component type developer where carrier dragging is prevented by reducing the content of fine particles in the carrier, the present invention provides another embodiment of the developer as described below. Namely, in accordance with another embodiment of the present invention, there is provided a two-component type developer in which the gradient and image density are improved while preventing occurrence of carrier dragging. The basic feature of this embodiment resides in that the diameter $D_{50}$ of the weight average particle size corresponding to 50% of the weight of the entire carrier particles (the particle size corresponding to the weight average particle size of the entire carrier particles) and the difference between $D_{25}$ and $D_{75}$ are adjusted within specific ranges. In the weight distribution of entire carrier particles of the developer, the weight of particles is cumulated from the and $D_{75}$ means the particle size observed when the side of the large particle size, and $D_{25}$ means the particle size observed when the cumulative value of the weight reaches 25% of the weight of the entire particles and $D_{75}$ means the particle size observed when the cumulative value of the weight reaches 75% of the weight of the entire particles.

In the present invention, the diameter $D_{50}$ of the weight average particle size corresponding to 50% of the weight of the entire carrier particles is adjusted to 80 to 120 μm and the difference between $D_{25}$ and $D_{75}$ is adjusted to 10 to 20 μm. This means sharpening of the particle size distribution of the carrier. If the developer comprising this sharpened carrier is used under a high bias voltage, that is, under a development voltage difference smaller than 500 V, at a DD-S width smaller than 1 mm, the image density of a solid image can be increased without substantial occurrence of carrier dragging. Namely, in the case where the image carrier and the developer support are of the drum type, if the average particle size is increased by sharpening the particle size distribution of the carrier, the torque is reduced, the sliding contact force of the drum is reduced, and even if the DD-S width is narrowed, the flowability and transferability of the developer can be maintained at sufficient levels and supply of the toner can be guaranteed while increasing the intensity of the electric field.

In the present invention, the saturation magnetization of the carrier is adjusted to 50 to 60 emu/g, whereby the magnetic brush is made softer than in the developer comprising the conventional developer. The drum stress is reduced if the magnetic brush is thus made softer, and a smooth flow of the developer is attained when the DD-S width is less than 1.2 mm, especially less than 1.0 mm, and moreover, disturbance of the toner image by the magnetic brush can be prevented and the reproducibility of a line image can be improved.

In this embodiment, in order to sufficiently prevent carrier dragging, a carrier in which the content of particles having a size smaller than 250 mesh is reduced as pointed out hereinbefore can be used. Moreover, a positively chargeable organic photosensitive material is preferably used in the present embodiment of the present invention.

Furthermore, according to the present invention, also in case of a two-component type developer comprising a color toner having a low electroconductivity, carrier dragging can be prevented by applying the above-mentioned technical idea of the present invention.

Namely, this embodiment is based on the finding that in a developer comprising a color toner having a low electroconductivity, if the particle size distribution of a magnetic carrier is adjusted within a specific range, the developer forms an image having a very high color density, and troubles such as carrier dragging are not caused.

The kinds of dyes and pigments for the color toner are limited, and the electroconductivity is generally low in the obtained color toners. Especially for a red toner, a dye or pigment giving a sufficient electroconductivity is hardly present. If a developer comprising a color toner having a low electroconductivity is used under conventional development conditions, a color image having a sufficiently high density cannot be formed.

In the present invention, the density of a color image is increased by using the developer under a developing condition of a DD-S width smaller than 1.2 mm, especially smaller than 1.0 mm, while maintaining the bias voltage at a high level. By diminishing the DD-S width and increasing the bias voltage as compared with the conventional development conditions, the transfer of the color toner to the photosensitive material is facilitated. Accordingly, the color density of a visible image formed on the photosensitive material is increased. Under these development conditions, there is a risk of occurrence of carrier dragging, but this risk is eliminated in case of the developer of the present invention by adjusting the particle size distribution of the carrier in a specific range.

In the present invention, by adjusting the particle size distribution of the carrier so that the diameter $D_{50}$ of the weight average particle size corresponding to 50% of the weight of the entire carrier particles is 80 to 100 μm and the particle size difference between $D_{25}$ to $D_{75}$ is 5 to 20 μm, an image having a high density can be obtained without substantial occurrence of carrier dragging even if the bias voltage is high, that is, the development voltage difference is lower than 500 V, and the DD-S width is smaller than 1.2 mm.

By the above-mentioned sharpening of the particle size distribution of the carrier, the content of small-size particles in the carrier is reduced to a level lower than in the conventional carrier. It is understood that when the bias voltage is increased and the DD-S width is diminished, the presence of small-size particles induces carrier dragging. In contrast, it is known that reduction of the particle size of the carrier results in elevation of the image density in solid images.

Preferred embodiments of the developer of the present invention will now be described.

The developer of the present invention is a two-component type developer comprising a magnetic carrier and a toner. The magnetic carrier, the toner and the developer will now be described in order.

Magnetic Carrier

Any of magnetic carriers can be used in the present invention, so far as the above-mentioned requirements of the particle size distribution are satisfied. Furthermore, ferrite particles having the surfaces covered with a resin can be used.

Preferably, the carrier particles have a spherical shape, and in case of spherical carrier particles in which the content of particles having size smaller than 250 mesh is lower than 8% by weight, especially 5% by weight, if the two-component type developer is supplied in the state where the bias voltage is high, especially the bias voltage is higher than 250 V, carrier dragging can be sufficiently prevented. If the magnetic carrier having this particle size distribution is used, fogging is not caused and an image having a high quality can be obtained.

According to the present invention, by adjusting the particle size distribution in the carrier particles, carrier dragging can be prevented and an image having a high quality can be obtained.

Namely, it is indispensable that the diameter $D_{50}$ of the weight average particle size corresponding to 50% of the weight of the entire carrier particles should be in the range of from 80 to 120 μm, especially from 90 to 110 μm. If the particle size difference between $D_{25}$ and $D_{75}$ of the magnetic carrier is 10 to 20 μm, the particle size distribution becomes sharper, and even if the DD-S width is further reduced from 1 mm, carrier dragging is not caused. Moreover, even in the state where the development voltage difference is small, carrier dragging can be prevented. In the magnetic carrier having the above-mentioned particle size distribution, reduction of the image density is not caused but the toner-supplying property is improved.

Incidentally, in the case where a color toner having a low electroconductivity is used, the carrier particles should have such a particle size distribution that the diameter $D_{50}$ of the weight average particle size corresponding to 50% of the weight of the entire carrier particles is in the range of from 80 to 100 μm and the particle size difference between $D_{25}$ and $D_{75}$ is in the range of from 5 to 20 μm. This particle size distribution is sharp, and even if the DD-S width is further shortened below 1.2 mm, carrier dragging is not caused, and in the case where the photosensitive material and the developing sleeve are of the drum type, the torque is reduced and the sliding contact force of the drum is reduced.

The magnetic carrier having a saturation magnetization of 50 to 60 emu/g is used. This range of the saturation magnetization is lower than the saturation magnetization range of the carrier for the conventional developer. As compared with the conventional carrier, this magnetic carrier promotes softening of the magnetic brush, which results in reduction of the drum stress. This saturation magnetization is preferred when the DD-S width is smaller than 1.2 mm, especially smaller than 1.0 mm. Incidentally, the range of the saturation magnetization specified in the present invention partially overlaps the range of the saturation magnetization of the conventional carrier.

When a voltage of 200 V is applied to the carrier used in the present invention, it is preferred that the current value be 0.5 to 3 μA, especially 1 to 2 μA. It is preferred that the flow rate of the carrier be 15 to 35 sec/50 g, especially 20 to 30 sec/50 g.

A ferrite can be mentioned as a specific example of the magnetic carrier, and sintered ferrite particles composed of at least one member selected from the group consisting of zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$). lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$) and lanthanum iron oxide ($LaFeO_3$) are used. Especially, a soft ferrite comprising at least one member, preferably at least two members, selected from the group consisting of Cu, Zn, Mg, Mn and Ni, for example, a copper/zinc/magnesium ferrite, is used.

At least one member selected from the group consisting of silicone resins, fluorine resins, acrylic resins. styrene resins, styrene-acrylic resins, olefin resins, ketone resins, phenolic resins, xylene resins and diallyl phthalate resins can be used as the coating resin. A straight silicone resin, that is, a silicone resin composed of an organopolysiloxane such as dimethylpolysiloxane, diphenylpolysiloxane or methylphenylpolysiloxane, which has a crosslinked structure, is most preferred. Crosslinking of the silicone resin is accomplished by including a hydrolyzable functional group such as a trimethoxy group or a functional group such as a silanol group in organopolysiloxane units, carrying out hydrolysis according to need, and causing a silanol condensation catalyst to act on the resin. The coating amount of the resin is preferably 0.5 to 3 parts by weight, especially preferably 0.8 to 1.5 parts by weight, per 100 parts by weight of the ferrite.

Toner

The toner used in the present invention is formed by incorporating a colorant and a charge controlling agent, and optionally other known toner additives, into a binder resin. A binder resin for a toner, a colorant, a charge controlling agent and other toner additives are appropriately selected and combined.

A styrene resin, an acrylic resin and a styrene/acrylic copolymer resin are generally used as the binder resin. As the styrene monomer, thee can be mentioned styrene, vinyltoluene, α-methylstyrene, α-chlorostyrene, vinylxylene and vinylphthalene. Among them, styrene is preferably used.

As the acrylic monomer, there can be mentioned, for example, ethyl acrylate, methyl methacrylate, butyl methacrylate, 2-ethylhexyl methacrylate, acrylic acid and methacrylic acid.

In addition to the above-mentioned monomers, ethylenically unsaturated carboxylic acids and anhydrides thereof, such as maleic anhydride, fumaric acid, maleic acid, crotonic acid and itaconic acid, can be used.

A styrene/acrylic copolymer resin is one of preferred binder resins. It is preferred that the styrene monomer (A)/acrylic monomer (B) weight ratio be in the range of from 50/50 to 90/10, especially from 60/40 to 85/15. In general, a resin having an acid value of from 0 to 25 is preferably used. From the viewpoint of the fixing property, it is preferred that the resin should have a glass transition temperature (Tg) of 50° to 65° C.

Inorganic and organic pigments and dyes mentioned below can be used singly or in combination as the colorant to be incorporated into the resin. For example, there can be used carbon blacks such as furnace black and channel black, iron black such as tiiron tetroxide, rutile type titanium dioxide and anatase type titanium dioxide, Phthalcyanine Blue, Phthalocyanine Green, cadmium yellow, molybdenum range, Phrazolone Red and Fast Violet B.

Known charge controlling agents, for example, oil-soluble dyes such as Nigrosine Base (CI 50415), Oil Black (CI 26150) and Spiron Black, metal salts of naphthenic acid, fatty acids, soaps and resin acid soaps, can be optionally used as the charge controlling agent.

Preferably, the particle size of toner particles is 8 to 14 μm, especially 10 to 12 μm, as the median size based on the volume, measured by a Coulter counter. The shape of the toner particles may be an indeterminate shape formed through melt kneading and pulverization, or a spherical shape formed by dispersion or suspension polymerization.

Lowly Electroconductive Toner

In the two-component type developer comprising a color toner according to the present invention, the electroconductivity of the color toner should be lower than $3.0\times10^{-10}$, especially lower than $2.6\times10^{-10}$. A binder resin for a toner and a colorant and other toner additives are incorporated in the same manner as described above. Pigments and dyes customarily used in this field can be used as the colorant. For example, pigments and dyes listed below can be used.

Red Pigments

Red iron oxide, cadmium red, red lead, mercury cadmium sulfide, Permanent Red 4R, Permanent Red FNG, Lithol Red, Pyrazolone Red, Watchung Red calcium salt, Lake Red D, Brilliant Carmine 6B, Eosine Lake, Rhodamine Lake, Brilliant Carmine 3B and Spiron Red.

Violet Pigments

Manganese violet, Fast Violet B Methyl Violet Lake.

Blue Pigments

Prussian blue, cobalt blue, Alkali Blue Lake, Phthalocyanine Blue, Metal-Free Phthalocyanine Blue, partially chlorinated Phthalocyanine Blue, Fast Sky Blue and Indanthrene Blue BG.

Orange Pigments

Chrome orange, molybdenum orange, Permanent Orange GTR, Pyrazolone Orange, Vulcan Orange, Indanthrene Brilliant Orange RK, Bensidine Orange G and Indanthrene Brilliant Orange GK.

Yellow Pigments

Chrome yellow, zinc yellow, cadmium yellow, naples yellow, Naphthol Yellow S, Nenzidine Yellow GR, Quinoline Yellow Lake, Permanent Yellow NCG and Tartrazine Lake.

Green Pigments

Chrome green, Pigment Green B, Marachite Green Lake and Fanal Yellow Green G.

White Pigments

Zinc flower, titanium oxide, antimony white and zinc sulfide.

Developers

In the developer of the present invention, it is preferred that the above-mentioned magnetic carrier and toner be mixed at a weight ratio of from 99/1 to 90/10, especially 98/2 to 95/5. It also is preferred that the initial charge quantity of the developer, as measured by the blow-off method, be 5 to 25 μc/g, especially 10 to 20 μc/g, and that the loose apparent specific gravity be 1.7 to 2.1 g/cm$^3$, especially 1.8 to 2.0 g/cm$^3$.

Figure 1:
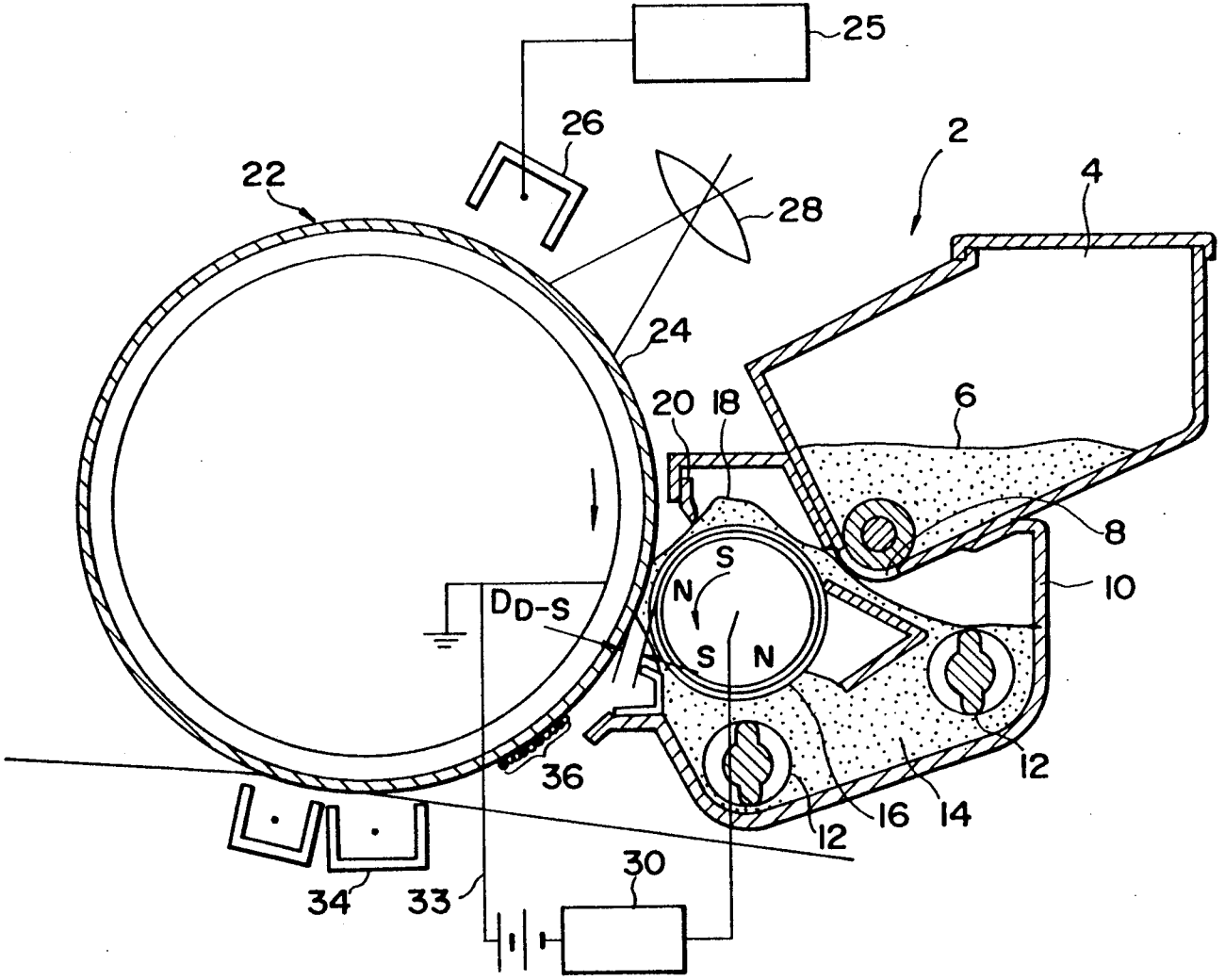
FIG. 1 is a diagram illustrating the developing mechanism.

Preferably, the developer of the present invention is used under such development conditions that the distance DD-S between the photosensitive material (drum) and the developer support (developing sleeve) is smaller than 1.2 mm and the development voltage difference is lower than 500 V. The photosensitive material and the developer support may be of the plane type, or they may be of the drum type as shown in FIG. 1, and the type is optional so far as DD-S is within the above-mentioned range.

Under development conditions were the DD-S width is smaller than 1.2 mm, especially smaller than 1.0 mm, the developer of the present invention gives an image having an excellent gradient and an excellent image density even by low-voltage development, and if the above-mentioned requirements for the carrier are additionally satisfied, carrier dragging and other troubles are not caused. Furthermore, it is preferred that with diminishment of the DD-S width, the brush cut length be 0.5 to 1.3 mm, especially 0.7 to 0.9 mm.

The developer of the present invention is used in the state where the development voltage difference is smaller than 500 V, especially smaller than 480 V. Accordingly, in the case where a surface voltage of 750 to 850 V is applied to the photosensitive material drum, a bias voltage of 250 to 350 V can be applied to the photosensitive material drum and the like. If the bias voltage is thus elevated, the photosensitive material drum can be used even if the residual voltage is higher than about 150 V, especially about 200 V.

Photosensitive materials customarily used for the electrophotography, such as a selenium photosensitive material, an amorphous silicone photosensitive material, a cadmium selenide photosensitive material, a zinc oxide photosensitive material and a cadmium sulfide photosensitive material, can be used as the photosensitive material. If a photosensitive material as mentioned above is used at the above-mentioned DD-S width, an image having an excellent gradient and an excellent image density can be obtained by the development using the developer of the present invention.

In the present invention, the developer is preferably used for a positively chargeable organic photosensitive material (OPC). The positively chargeable organic photosensitive material comprises a charge-generating material and a charge-transporting material, which are mixed mainly in one layer, and therefore, an electron an a hole migrate in this one layer and one of them acts as a trap, with the result that the residual voltage tends to increase. This photosensitive material should have a bias voltage of at least 250 V or at least 280 V under certain circumstances. The developer of the present invention can form an excellent image even under such a high bias voltage, and carrier dragging is not caused.

A photosensitive material formed by combining a known charge-generating material with a known charge-transporting material can be used as the positively chargeable photosensitive material. An organic photosensitive material previously proposed in Japanese Patent Application No. 62-277158 is especially preferably used as the positively chargeable photosensitive material.

The present invention will now be described in detail with reference to the following examples that by no means limit the scope of the invention.

EXAMPLES 1 and 2 and COMPARATIVE EXAMPLES 1 through 4

The components of the two-component type developer and the development conditions were set as follows.

The two-component type developer was supplied by applying a bias voltage of at least 250 V, and a ferrite carrier coated with an acrylic resin was used as the magnetic carrier of the two-component type developer. The content of carrier particles having a size smaller than 250 mesh was adjusted as shown in Table 1. The basic characteristics were as shown in Table 1.

The toner used was prepared by using a styrene-acrylic resin, carbon black and other additives, and the particle size was adjusted within the range of 10 to 14 μm. The toner and carrier were mixed at a weight ratio of 4.5/95.5 to form a two-component type developer. The basic properties were as shown in Table 1.

The DD-S width, the brush cut length, the development voltage difference and the photosensitive material were as shown in Table 1.

The results (carrier dragging, image density and fog density) obtained by carrying out the development by using the developer comprising the above-mentioned components were as shown in Table 1.

When the results of Examples 1 and 2 are compared with the results of Comparative Examples 1 through 4, it is seen that in Comparative Examples 2 and 3 where the bias voltage was low, a problem of increase of the fog density arose, and that if the content of carrier particles having a size smaller than 250 mesh exceeded 8% by weight, carrier dragging became conspicuous though the image density was good.

development difference to less than 500 V (see Table 2), and a ferrite carrier coated with an acrylic resin was used as the magnetic carrier of the two-component type developer. The particle size distribution of the carrier particles was adjusted so that $D_{50}$ was 80 to 120 μm and the difference between $D_{25}$ and $D_{75}$ was 10 to 20 μm. The saturation magnetization was adjusted to 50 to 60 emu/g. Other basic properties were as shown in Table 2.

A toner was prepared by using a styrene-acrylic resin, carbon black and other additives, and the particle size was adjusted to 10 to 14 μm.

The two-component type developer was prepared by mixing the toner and carrier at a weight ratio of 4.5/95.5. The basic properties were as shown in Table 2.

The brush cut length, the bias voltage and the photosensitive material were as shown in Table 2.

The results (carrier dragging, image density, resolution and fog density) obtained by using the developer comprising the above-mentioned components were as shown in Table 2.

When the results of Example 3 were compared with the results of Comparative Example 5 it is seen that if the particle size distribution (weight average particle size) was adjusted within the specific range, carrier dragging was prevented or controlled and the resolution was improved. Even if the development voltage difference was large as in Comparative Example 6, when the carrier failed to satisfy the requirement specified in the present invention, occurrence of carrier dragging was not prevented, the fog density was increased and the resolution was degraded.

TABLE 1

| | Unit | Example 1 | Example 2 | Comparative Example 1 | Comparative Example 2 | Comparative Example 3 | Comparative Example 4 |
|---|---|---|---|---|---|---|---|
| Components | | | | | | | |
| magnetic carrier | | | | | | | |
| content of particles having size smaller than 250 mesh | % by weight | 8.0 | 5.0 | 30 | 30 | 8.0 | 30 |
| particle size distribution | | | | | | | |
| $D_{50}$ | | 80 | 82 | 80 | 75 | 80 | 70 |
| $D_{25}$ | | — | — | — | — | — | — |
| $D_{75}$ | | — | — | — | — | — | — |
| saturation magnetization | emu/g | 65 | 55 | 65 | 65 | 65 | 65 |
| current value | μA | 1.2 | 5 | 3 | 3 | 1.2 | 3 |
| apparent density | g/cm$^3$ | 2.5 | 2.7 | 2.8 | 3.0 | 2.5 | 2.8 |
| flow rate | sec/50 g | 25 | 28 | 30 | 30 | 25 | 30 |
| developer | | | | | | | |
| loose apparent density | g/cm$^3$ | 1.88 | 1.93 | 2.01 | 2.21 | 1.88 | 2.01 |
| initial charge quantity | μc/g | 17 | 15 | 20 | 23 | 17 | 20 |
| Development Condition | | | | | | | |
| $D_{D-S}$ width | mm | 0.8 | 1.2 | 0.8 | 0.8 | 1.3 | 0.8 |
| brush cut length | mm | 0.7 | 1.0 | 0.7 | 0.7 | 1.2 | 0.7 |
| development voltage difference | V | 460 | 500 | 460 | 560 | 560 | 500 |
| bias voltage | V | 290 | 250 | 290 | 190 | 220 | 250 |
| Result | | | | | | | |
| carrier dragging (g/1500 copies) | | 0.15 | 0.10 | 5.00 | 3.00 | 0.10 | 2.0 |
| image density | | 1.43 | 1.40 | 1.41 | 1.43 | 1.18 | 1.39 |
| fog density | | 0.002 | 0.001 | 0.003 | 0.015 | 0.011 | 0.002 |
| Photosensitive Material | | OPC | Se | OPC | OPC | OPC | Se |

Note:
Carrier dragging was expressed by the weight of the carrier recovered in the cleaning zone after formation of 500 copies (same as in Tables 2 and 3).

EXAMPLES 3 through 5 and COMPARATIVE EXAMPLES 5 through 8

Components of the two-component type developer and the developing conditions were set as described below.

A two-component type developer was supplied at a DD-S width smaller than 1 mm while adjusting the

TABLE 2

| Properties | Example 3 | Example 4 | Example 5 | Comparative Example 5 | Comparative Example 6 | Comparative Example 7 | Comparative Example 8 |
|---|---|---|---|---|---|---|---|
| Components | | | | | | | |
| magnetic carrier | | | | | | | |
| content of particles having size smaller than 250 mesh: | 3 | 1 | 0.5 | 3 | 8.0 | 10 | 10 |

TABLE 2-continued

| Properties | Example 3 | Example 4 | Example 5 | Comparative Example 5 | Comparative Example 6 | Comparative Example 7 | Comparative Example 8 |
|---|---|---|---|---|---|---|---|
| % by weight | | | | | | | |
| particle size distribution | | | | | | | |
| $D_{50}$: μm | 105 | 102 | 111 | 130 | 80 | 80 | 80 |
| $D_{25}$ | 110 | 107 | 116 | 140 | 85 | 92 | 92 |
| $D_{75}$ | 100 | 97 | 106 | 123 | 75 | 68 | 68 |
| saturation magnetization: emu/g | 55 | 53 | 54 | 55 | 5.5 | 63 | 63 |
| current: μA | 1.25 | 1.1 | 1.4 | 1.3 | 1.2 | 1.3 | 1.3 |
| apparent density: g/cm$^3$ | 2.6 | 2.5 | 2.64 | 2.55 | 2.5 | 2.6 | 2.6 |
| flow rate: sec/50 g | 27 | | | | 25 | 2.8 | 2.8 |
| toner | | | | | | | |
| particle size: μm | 12 | 12 | 12 | | | 12 | |
| coloring agent | | | | | | | |
| electroconductivity of colorant | $5 \times 10^{-10}$ | $5 \times 10^{-10}$ | $5 \times 10^{-10}$ | | | $5 \times 10^{-10}$ | |
| developer | | | | | | | |
| apparent density: g/cm$^3$ | 1.9 | 1.9 | 1.9 | | | 1.9 | |
| initial charge quantity: μc/g | 15 | 15 | 15 | | | 15 | |
| Development Conditions | | | | | | | |
| $D_{D-S}$ width: mm | 0.8 | | | 0.8 | 0.8 | | 1.2 |
| brush cut length: mm | 0.7 | 0.7 | 0.7 | 0.7 | 0.7 | 0.7 | 1.1 |
| development voltage: V | 460 | — | — | 460 | 560 | — | 460 |
| bias voltage: V | 290 | — | — | 290 | 190 | — | 290 |
| Results | | | | | | | |
| carrier dragging: g/500 copies | 0.02 | 0.01 | 0.02 | 0.01 | 0.05 | 0.3 | 0.1 |
| image density | 1.41, good | 1.39, good | 1.43, good | 1.16 | 1.45 | 1.41, good | 1.19 |
| resolution: lines/mm | 6.3 | 6.3 | 6.3 | 4.5 | 3.0 | 4.0 | 4.0 |
| fog density | 0.001 | 0.001 | 0.002 | 0.001 | 0.016 | 0.006 | 0.003 |
| Photosensitive Material | OPC* | OPC* | OPC* | OPC* | Se | Se | OPC* |

OPC*: positively chargeable OPC

EXAMPLE 6 through 9 and COMPARATIVE EXAMPLES 9 through 11

The components of the two-component type developer and the development conditions were set as described below.

A spherical uncoated ferrite carrier was used as the magnetic carrier of the two-component type developer. The particle size distribution of the range of from 80 to 100 μm and the difference between $D_{25}$ and $D_{75}$ was 5 to 20 μm. The content of carrier particles having a size smaller than 250 mesh was adjusted as show in Table 3. Other basic properties were as show in Table 3.

A toner having an electroconductivity of $2.9 \times 10^{-10}$s/cm and comprising Monoazo Red Pigment (C.I. Pigment Red 112) as the colorant was used. The particle size of the toner was 13 μm.

The two-component type developer was prepared by mixing the toner and the carrier at a weight ratio of 4.4/95.5. The basic properties of the developer were as shown in Table 3.

The brush cut length, the development voltage difference, the bias voltage and the photosensitive material were as shown in Table 3.

The results (carrier dragging and image density) obtained by the development using the developer comprising the above components were as shown in Table 3. From the results obtained in the examples and comparative examples, it is seen that carrier dragging was controlled and the image density was improved according to the present invention.

TABLE 3

| Properties | Example 6 | Example 7 | Example 8 | Example 9 | Comparative Example 9 | Comparative Example 10 | Comparative Example 11 |
|---|---|---|---|---|---|---|---|
| Components | | | | | | | |
| magnetic carrier | | | | | | | |
| content of particles having size smaller than 250 mesh: % by weight | 0.5 | 2.5 | 0.5 | 3 | 9.3 | 3 | 9 |
| particle size distribution | | | | | | | |
| $D_{50}$: μm | 93 | 94 | 90 | 86 | 84 | 75 | 110 |
| $D_{25}$ | 97 | 98 | 94 | 90 | 96 | 79 | 114 |
| $D_{75}$ | 89 | 89 | 86 | 83 | 73 | 72 | 105 |
| saturation magnetization: emu/g | 64 | 53 | 64 | 53 | 54 | 53 | 54 |
| current value: μA | 35 | 40 | 35 | 40 | 30 | 40 | 40 |
| apparent density: g/cm$^3$ | 2.52 | 2.63 | 2.54 | 2.54 | 2.72 | 2.75 | 2.45 |
| flow rate: sec/50 g | 27 | 27 | 27 | 25 | 26 | 28 | 28 |
| toner | | | | | | | |
| particle size: μm | 13 | 13 | 13 | 13 | 13 | 13 | 13 |
| coloring agent | C.I.P.R113 | C.I.P.R113 | C.I.P.R113 | C.I.P.R113 | C.I.P.R113 | C.I.P.R113 | C.I.P.R113 |
| electroconductivity of colorant: S/cm | $2.9 \times 10^{-10}$ | $2.9 \times 10^{-10}$ | $2.9 \times 10^{-10}$ | $2.9 \times 10^{-10}$ | $2.9 \times 10^{-10}$ | $2.9 \times 10^{-10}$ | $2.9 \times 10^{-10}$ |
| developer | | | | | | | |
| apparent density: g/cm$^3$ | 1.83 | 1.85 | 1.82 | 1.82 | 1.92 | 1.95 | 1.79 |
| initial charge quantity: μc/g | 25 | 24 | 25 | 25 | 29 | 27 | 20 |

TABLE 3-continued

| Properties | Example 6 | Example 7 | Example 8 | Example 9 | Comparative Example 9 | Comparative Example 10 | Comparative Example 11 |
|---|---|---|---|---|---|---|---|
| Development Condition | | | | | | | |
| $D_{D-S}$ width: mm | 0.8 | 0.8 | 0.8 | 0.8 | 0.8 | 1.2 | 0.8 |
| brush cut length: mm | 0.7 | 0.7 | 0.7 | 0.7 | 0.7 | 1.0 | 0.7 |
| development voltage difference: V | 460 | 460 | 460 | 460 | 460 | 460 | 590 |
| bias voltage: V | 290 | 290 | 290 | 290 | 290 | 290 | 190 |
| Results | | | | | | | |
| carrier dragging (g/500 copies) | 0.10 | 0.2 | 0.1 | 0.2 | 1.82 | 0.31 | 0.15 |
| image density (visual observation) | good | good | good | good | good | insufficient | insufficient |
| Photosensitive Material | OPC* | OPC* | OPC* | OPC* | OPC* | OPC* | Se |

OPC*: positively chargeable OPC

As is apparent from the foregoing illustration, if the bias voltage is increased and fine particles are removed from the carrier used for the two-component type developer according to the present invention, occurrence of carrier dragging can be sufficiently prevented.

Furthermore, according to the present invention, since the particle size distribution of carrier particles is adjusted so that the above-mentioned requirements for the weight average particle size $D_{50}$ and the difference between $D_{25}$ and $D_{75}$ are satisfied, and the saturation magnetization of the carrier is adjusted within the specific range, occurrence of carrier dragging is prevented and furthermore, an image having a high quality and an excellent gradient can be obtained.

Moreover, according to the present invention, even if a toner having a low electroconductivity is used, occurrence of carrier dragging is prevented and a colored image having a high density can be formed. Moreover, even in case of a red color toner involving a problem of a low electroconductivity, a red image having a high color density can be formed when the developer of the present invention is used.

We claim:

1. A developing process which comprises (i) preparing a two-component developer by mixing toner particles and spherical ferrite carrier particles wherein diameter $D_{50}$ of the weight average particle size corresponding to 50% of the weight of entire carrier particles is in the range of from 80 to 100 microns, the difference between the diameter $D_{25}$ of the weight average particle size corresponding to 25% of the weight of entire carrier particles and the diameter of $D_{75}$ of the weight average particle size corresponding to 75% of the weight of entire carrier particles is in the range of from 5 to 20 microns, and particles having a particle size smaller than 250 mesh occupy less than 8% by weight of the entire particles, and wherein the weight ratio of magnetic carrier to toner is less than 95/5, and the saturation magnetization of the carrier is in the range of 50 to 65 emu/g, (ii) feeding said two-component developer onto a developing sleeve equipped with magnetic poles and forming a magnetic brush of said two-component developer on the surface of said sleeve, (iii) applying a bias voltage of 250 to 350 V between a positively chargeable organic photosensitive material drum having a surface voltage of 750 to 850 V and said developing sleeve so that the development voltage difference is no greater than 500 V, wherein the photosensitive material drum and the developing sleeve are maintained at a distance apart of less than 1.2 mm, and (iv) contacting said magnetic brush of said two-component developer with the surface of the photosensitive material drum to form a toner image on the surface of said drum.

2. A developing process which comprises (i) preparing a two-component developer by mixing toner particles and spherical ferrite carrier particles wherein diameter $D_{50}$ of the weight average particle size corresponding to 50% of the weight of entire carrier particles is in the range of from 80 to 120 microns, the difference between the diameter $D_{25}$ of the weight average particle size corresponding to 25% of the weight of entire carrier particles and the diameter $D_{75}$ of the weight average particle size corresponding to 75% of the weight of entire carrier particles is in the range of from 10 to 20 microns, and particles having a particle size smaller than 250 mesh occupy less than 8% by weight of the entire particles, and the saturation magnetization of the carrier is in the range of 50 to 65 emu/g, (ii) feeding said two-component developer onto a developing sleeve equipped with magnetic poles and forming a magnetic brush of said two-component developer on the surface of said sleeve, (iii) applying a bias voltage of 250 to 350 V between a positively chargeable organic photosensitive material drum having a surface voltage of 750 to 850 V and said developing sleeve so that the development voltage difference is no greater than 500 V, wherein the photosensitive material drum and the developing sleeve are maintained at a distance apart of less than 1.2 mm, and (iv) contacting said magnetic brush of said two-component developer with the surface of the photosensitive material drum to form a toner image on the surface of said drum.

3. The developing process of claim 2 wherein the weight ratio of magnetic carrier to toner is less than 95/5.

4. The developing process of claim 2 wherein the weight ratio of magnetic carrier to toner is from 98/2 to less than 95/5.

* * * * *